United States Patent [19]

Israel et al.

[11] Patent Number: 4,902,564

[45] Date of Patent: Feb. 20, 1990

[54] HIGHLY ABSORBENT NONWOVEN FABRIC

[75] Inventors: Joseph Israel, Greenville; Stuart P. Suskind, Greer, both of S.C.

[73] Assignee: James River Corporation of Virginia, Richmond, Va.

[21] Appl. No.: 151,913

[22] Filed: Feb. 3, 1988

[51] Int. Cl.[4] ..... B32B 5/06

[52] U.S. Cl. ..... 428/284; 28/104; 28/105; 428/286; 428/287; 428/288; 428/296; 428/299; 428/301

[58] Field of Search ..... 428/284, 286, 287, 288, 428/296, 299, 301; 28/104, 105

[56] References Cited

U.S. PATENT DOCUMENTS 4,442,161 4/1984 Kirayoglu et al. ..... 428/288

4,775,579 10/1988 Hagy et al. ..... 428/284

4,808,467 2/1989 Suskind et al. ..... 428/284

*Primary Examiner*—Marion C. McCamish

*Attorney, Agent, or Firm*—William A. Aquele; Richard J. Gallagher; Thomas H. Whaley

[57] ABSTRACT

A strong, highly absorbent hard finished nonwoven toweling fabric consisting of wood pulp and textile fibers free from added binders is prepared by forming a wet-laid web of a blend of fibers containing 50 to 75 weight percent wood pulp and 25 to 50 weight percent staple length synthetic fibers and subjecting the fibers in the wet-laid web to hydroentanglement. The fabric may be apertured or essentially nonapertured and may be made water repellant. The fabric may be used in medical and surgical application, household cloths, food service wipes, industrial machinery wipes and the like.

12 Claims, 2 Drawing Sheets

HIGHLY ABSORBENT NONWOVEN FABRIC

This invention relates to highly absorbent hydroentangled nonwoven fabrics containing wood pulp and textile length fibers, and to methods of their preparation. In one of its more specific aspects, the present invention relates to a unique apertured or nonapertured composite fabric consisting essentially of a relatively high proportion of wood pulp intimately entangled with synthetic staple fibers. In another of its more specific aspects, a non-apertured, strong, highly absorbent fabric suitable for use as disposable surgical toweling is produced by blending wood pulp and staple synthetic polymer fibers, dispersing the blend of fibers in an aqueous carrier, forming a wet-laid web of blended fibers, and subjecting the wet-laid web to the action of high pressure fluid jets.

Composite webs made up of various combinations of fibers are known in the prior art. Nonwoven fabrics in which staple length textile fibers are hydroentangled with continuous filaments are disclosed in U.S. Pat. Nos. 3,494,821 and 4,144,370. In U.S. Pat. No. 3,917,785, staple rayon fibers are blended with wood pulp, supported on an impermeable patterned support, and subjected to the force of water from jets to hydroentangle the fibers and form an apertured fabric. In U.S. Pat. Nos. 3,917,785 and 4,442,161, a layer of textile fibers, which may be mixed with wood pulp, is supported on a foraminous screen and hydroentangled by means of hydraulic jets to form a non-woven fabric.

Nonwoven fibrous webs comprising mixtures of wood pulp and synthetic fibers have high moisture absorption capabilities and may be inexpensively produced by conventional papermaking procedures. However, such products also tend to have relatively low wet strength properties and lack sufficient strength for many applications, for example, for use as surgical towels, household cloths, food service wipes and industrial machinery wipes. The strength of such products may be improved by including a bonding agent in the fiber furnish or by application of an adhesive binder to the formed web. While the strength characteristics of the web are improved by use of an adhesive binder, such as a synthetic resin latex, the liquid absorption capability of the web is correspondingly decreased.

We have now discovered that a high strength, nonwoven highly absorbent fabric having visual and clothlike hand characteristics of a woven towel and superior moisture absorption may be produced from a homogeneous blend of wood pulp and long synthetic fibers by forming first a wet laid web or blanket of the fibers in the desired relative proportions and subjecting the wet laid web to hydroentanglement with sufficient energy to form a relatively dense, cohesive, uniform fabric. In one specific embodiment of this invention, a wet laid web of wood pulp and staple synthetic staple fibers is formed in known manner and subjected to hydraulic entanglement. As a specific example, a wet-laid web made up of 50 to 75 weight percent wood pulp and 25 to 50 weight percent polyester fibers hydroentangled at an energy input of the order of 10,000 KPa produces a strong nonwoven fabric having superior water absorption qualities as compared with woven cotton huckaback towels and comparable hand characteristics with clothlike softness and texture.

The nonwoven fabrics of this invention containing a substantial proportion of wood pulp are strong when wet and highly absorbent, and do not require stabilization with a latex adhesive. The staple length fiber may be produced by known methods from any of various synthetic resins including polyolefins, nylons, polyesters, and the like; polyester fibers are preferred.

In accordance with the present invention, the synthetic textile fibers are blended with wood pulp and formed into a web by a wet-laying process technique as utilized in the paper and nonwovens industries. One or more such composite wet-laid webs are then subjected to hydraulic entanglement producing a uniform spunlaced composite fabric with superior water absorption properties. A preferred method and apparatus for hydraulically entangling the fibers is disclosed in U.S. Pat. No. 3,494,821, incorporated herein by reference.

Preferably, the composite wet-laid web is produced by a conventional wet-laid papermaking method by dispersing a uniform furnish of wood pulp fibers and staple synthetic fibers onto a foraminous screen of a conventional papermaking machine. Conway U.S. Pat. No. 4,081,319 and Brandon et al. U.S. Pat. No. 4,200,488 disclose wet-laying methods which may be used to produce a uniform web of wood pulp and staple fibers. A preferred method of dispersing a mixture of staple fibers and wood pulp is disclosed in commonly assigned copending U.S. patent application Ser. No. 07/035,059 filed Apr. 6, 1987.

While various wood pulps may be incorporated into the finished fabric by the method disclosed herein, those pulps which are characterized by long, flexible fibers of a low coarseness index are preferred. Wood fibers with an average fiber length of three to five millimeters are especially suited for use in the spunlaced fabrics. Western red cedar, redwood and northern softwood kraft pulps, for example are among the more desireable wood pulps useful in the nonwoven spunlaced fabrics of my invention.

Staple fiber length is an important factor affecting the strength and abrasion resistance of the resulting fabric. Staple fibers which are either too short or too long do not entangle as well as those in the range of from about one-quarter inch to about one inch. Staple fibers in the range of one-half inch to seven-eighths inch in length are preferred for use in the process of this invention. Shorter staple fiber lengths in the range of from about one-quarter to one-half inch result in lowered tear strength of the finished product.

The wood pulp content of the improved nonwoven web produced in accordance with the present invention may be in the range of from about 50 weight percent to about 75 weight percent. For most applications, a wood pulp content in the range from about 55 weight percent to 65 weight percent is preferred. The higher levels of wood pulp impart increase absorbency of the product, but usually result in some loss of abrasion resistance, and tensile strength.

In carrying out the process of the present invention, the entangling treatment described in the prior art, for example, by the hydroentanglement process disclosed in F. J. Evans U.S. Pat. No. 3,485,706, or Bunting Jr., et al. U.S. Pat. No. 3,560,326, incorporated herein by reference, may be employed. As known in the art, the product fabric may be patterned by carrying out the hydroentanglement operation on a patterned screen or foraminous support. Nonpatterned products also may be produced by supporting the layer or layers of fibrous material on a smooth supporting surface during the hydroentanglement treatment as disclosed in Bunting, Jr. et al. U.S. Pat. No. 3,493,462.

The basis weight of the finished fabric may range from about 3 ounces per square yard to about 8 ounces per square yard. The lower limit generally defines the minimum weight at which acceptable water absorption and web strength can be attained. The upper limit generally defines the weight above which the water jets are not effective to produce a uniformly entangled web.

The wet-laid web may be produced on-site and fed directly from the web-forming apparatus to the hydroentangling apparatus without the need for drying or bonding of the web prior to hydroentanglement. Alternatively, the wet-laid composite web may be produced at a separate site, dried and supplied in rolls to the site of the hydroentanglement device.

The separately formed wet-laid web containing the staple length textile fibers and wood pulp fibers is hydroentangled by water jets while supported on a foraminous screen or belt, preferably one made up of synthetic continuous filaments woven into a screen. The web is transported on the screen under several water jet manifolds of the type described in U.S. Pat. No. 3,485,706. The water jets entangle the discrete staple fibers and wood fibers present in the web producing an intimately blended strong absorbent composite fabric. After drying, the resulting fabric is soft and is a suitable material for conversion to surgeon's hand towels, and other products useful in disposable personal care or health care applications, or as a durable, multiple use products. Food service wipes, domestic hand towels or dish towels, and other utility wipes made up of spunlaced synthetic staple fibers and wood pulp are stronger, more absorbent and generally superior in service to cloth toweling and similar products made up of hydroentangled rayon bonded with latex or those made up of scrim reinforced cellulose tissue.

Colored fabrics may be made up from dyed wood pulp, or dyed or pigmented textile staple fibers or both.

The fabric may be sterilized by currently known and commercially available sterilization processes, e.g., gamma irradiation, ethylene oxide gas, steam, and electron beam methods of sterilization.

The fabric may also be post texturized by many of the existing and commercially available technologies, e.g. hot or cold embossing, micro creping, to impart added softness, pliability, bulky appearance, clothlike feel and texture. By proper selection of the entangling screen, the fabric may be given a fine linen like pattern and texture. The fabric also may be post embossed with matched plates; the combination of embossing and fine linen like screen pattern imparts a unique appearance, clothlike feel, bulk, softness and texture to the fabric.

Figure 1:
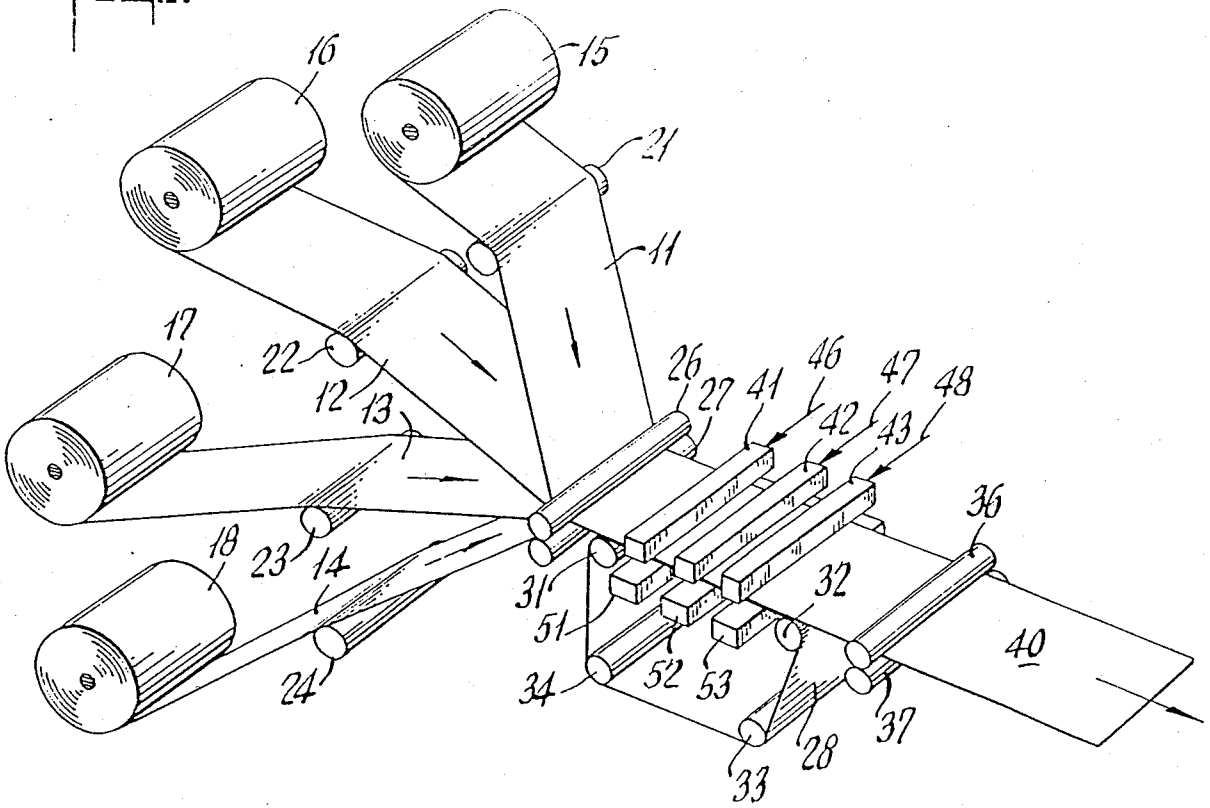
FIG. 1 is a simplified, diagrammatic perspective view of hydroentanglement apparatus illustrating one specific embodiment of a suitable method for making the nonwoven fabric of this invention from one or more wetlaid webs.

Preformed wet-laid webs 11, 12, 13 and 14 made up of an intimate blend of staple fibers and wood pulp are drawn from supply rolls 15, 16, 17 and 18 over guide rolls 21, 22, 23 and 24 by feed rolls 26 and 27 onto a foraminous carrier belt 28 as shown in FIG. 1. A woven polyester screen formed of a flexible material is suitable as a carrier belt for transporting the wet-laid webs through the hydroentanglement apparatus to form a uniform fabric web 40. The carrier belt 28 is supported on rolls 31, 32, 33 and 34, one or more of which may be driven by suitable means, not illustrated. A pair of rolls 36 and 37 remove the hydroentangled web fabric 40 from the belt 28 for drying and subsequent treatment.

Several orifice manifolds 41, 42 and 43 are positioned above the belt 28 to discharge small diameter, high velocity jet streams of water onto the wet-laid webs and resulting composite web 40 as it moves from rolls 26 and 27 to rolls 36 and 37. Each of the manifolds 41, 42 and 43 is connected with a source of water under pressure through conduits 46, 47 and 48, and each is provided with one row of 0.005 inch diameter orifices spaced on 0.025 inch centers (to provide 40 orifices per linear inch) along the lowermost surface of each of the manifolds. The spacing between the orifice outlets of the manifolds and the web directly beneath each manifold is preferably in the range of from about one-quarter inch to about one-half inch. Water from jets discharged from the orifices which passes through the web 40 and the screen 28 is removed by vacuum boxes 51, 52 and 53. Although only three manifolds are illustrated, representing three separate pressure stages, as many as fourteen manifolds are preferred, the first two operating at a manifold pressure of about 200 psig and the remainder at pressures in the range of 400 to 800 psig as described in the specific examples herein.

EXAMPLE 1

In this example, a 2/1 twill, 31×25 mesh, polyethylene terephthalate (PET) screen from National Wire Fabric Corporation having a warp diameter of 0.0199 inch and a shute diameter of 0.0197 inch with an open area of 22.9 percent and an air permeability of 590 cubic feet per minute is used as the carrier belt for the hydroentanglement operation.

A wet laid (3.8 oz./sq. yd.) (79 lb./ream) web is prepared from a mixture of 60 weight percent long fiber northern softwood kraft pulp and 40 weight percent of 1.5 denier by three-quarter inch polyethylene terephthalate (PET) staple fibers. The web is passed at a speed of 240 ft./min. under water jets from a manifold provided with a row of 0.005 inch diameter orifices spaced 0.025 inch apart extending across the full width of the web. The fibers in the web are hydroentangled by subjecting them to two passes under the rows of water jets operating at a manifold pressure of 200 psig (1380 KPa), four passes at a manifold pressure of 400 psig (2760 KPa), and eight passes at a manifold pressure of 800 psig (5520 KPa).

Properties of the resulting hard finished nonwoven fabric produced in this example are shown in the accompanying table (Sample A) in comparison with the properties of several commercially available products including the conventional "huck" (huckaback) cotton towels.

TABLE I

| SAMPLE | A | B(1) | C(2) | D(3) |
|---|---|---|---|---|
| Basis Weight | | | | |
| (oz/sq yd) | 3.8 | 3.1 | 2.25 | 7.8 |
| Thickness (mils) | 35 | 25 | 18 | 57 |
| Grab Tensile (lb) | | | | |
| MD Wet | 19 | 6 | 5 | 97 |
| CD Wet | 19 | 5 | 5 | 82 |

TABLE I-continued

| SAMPLE | A | B(1) | C(2) | D(3) |
|---|---|---|---|---|
| Grab Elongation (%) | | | | |
| MD Wet | 90 | 25 | 34 | 34 |
| CD Wet | 100 | 50 | 26 | 26 |
| Elmendorf Tear (g) | | | | |
| MD Wet | 1600 | 200 | 80 | 4000 |
| CD Wet | 1900 | 220 | 50 | 4000 |
| Absorption Capacity | | | | |
| (g/g) | 6.2 | 4.2 | 3.6 | 3.2 |
| Area Capacity | | | | |
| ($g/m^2$) | 850 | 450 | 280 | 936 |
| Wicking Rate | | | | |
| (g/g/sec) | 38.7 | 29.9 | 26.8 | 16.8 |
| Bulk Density | | | | |
| (cc/g) | 8.2 | 6.1 | 5.8 | 4.8 |
| Flammability (sec) | | | | |
| NFPA-702 - MD | 6.5 | 5.5 | 4.3 | 16.8 |
| NFPA-702 - CD | 7.4 | 6.5 | 4.4 | 15.6 |

(1)Sample B is a hydroentangled 100% rayon fiber towel containing a latex binder sold under the trade name J&J Surgisorb, by Johnson & Johnson, New Brunswick, New Jersey.
(2)Sample C is a scrim reinforced tissue product having two to four plies of wood cellulose tissue reinforced by an internal web of synthetic fiber sold under the trade name Kaycel by Kimberly Clark Corporation of Neenah, Wisconsin.
(3)Sample D is a generic huckaback woven cotton towel.

Figure 2:
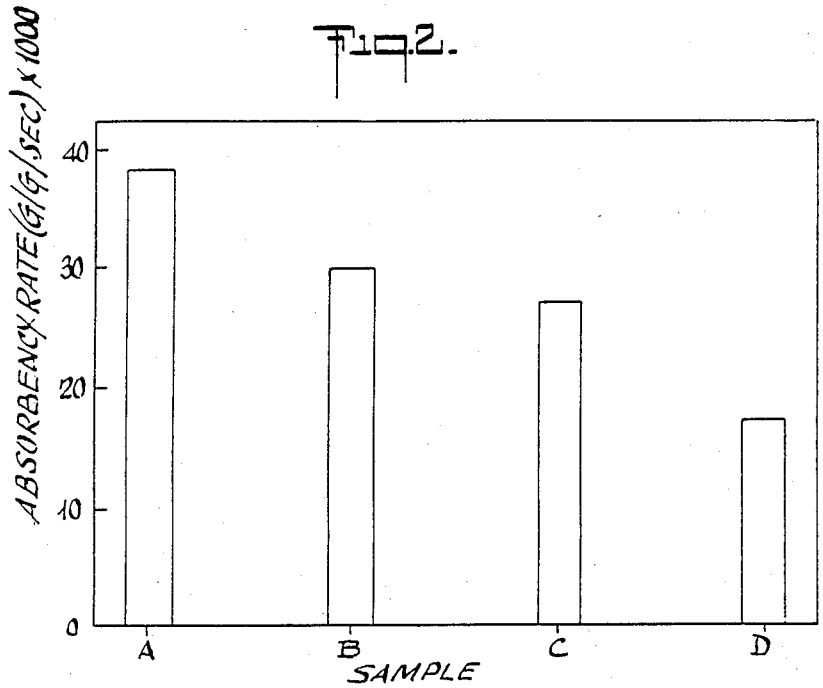
FIG. 2 is a bar graph illustrating the wicking rate (absorbency rate) of samples, the test results of which are reported in Table I.
Figure 3:
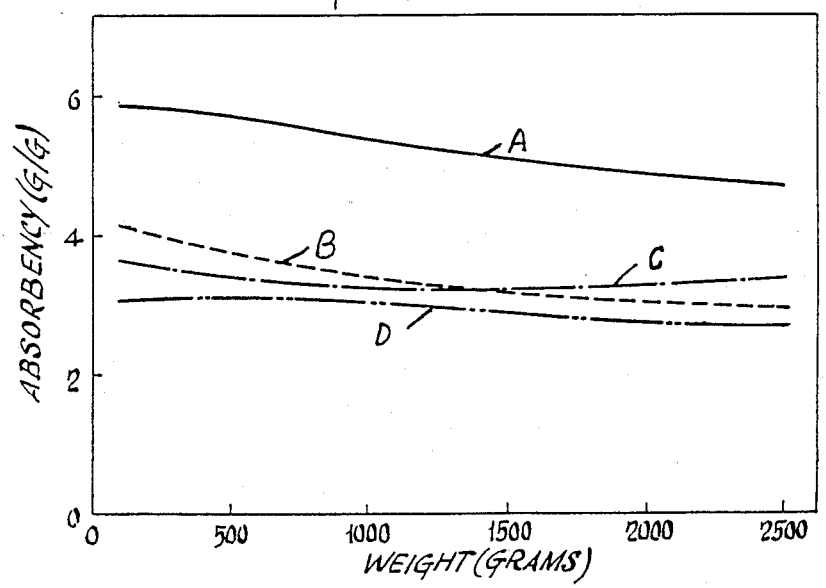
FIG. 3 illustrates graphically the absorbency under load of the samples A, B, C and D of FIG. 2.

It will be evident from the foregoing example that the nonwoven fabric of this invention (Sample A) provides superior absorption capacity as compared with conventional huckaback woven cotton towels (Sample D) and currently available non-woven fabrics represented by Samples Band C, FIG. 2. The absorption capacity of Sample A of our nonwoven fabric is twice that of the huck towel, on a weight basis; the nonwoven fabric is approximately 50% lighter in basis weight. Even at the lower basis weight, the fluid area capacity of the nonwoven fabric (Sample A) compares favorably with that of the huck towel (Sample D), FIG 3.

EXAMPLES 2 TO 5

In these examples, fabrics are produced by forming wet-laid webs of varying fiber compositions and subjecting the wet-laid webs to the conditions described in Example 1. The forming screen in Examples 2 and 3 is the same as that of Example 1. In Example 4, the forming screen is made up of PET fibers with a warp diameter of 0.024 inch and a shute diameter of 0.028 inch and an air permeability of 555 cfm. The forming screen of Example 5 is made up of PET fibers with a warp diameter of 0.042 inch, shute diameter of 0.049 inch.

In Examples 2 and 3, the fabric is made up from four layers of wet-laid substrate as illustrated in FIG. 1 of the drawings. The PET component of Examples 2 and 3 is three-quarters inch, 1.5 denier staple fibers; in Examples 4 and 5, the PET fibers are three-quarters inch, 1.2 denier. In Examples 4 and 5, the fabric is made up from two layers of wet-laid substrate.

Physical properties of the finished fabrics are shown in Table II. The data from Sample A of Example 1 are repeated for comparison purposes.

TABLE II

| SAMPLE<br>EXAMPLE | A<br>1 | E<br>2 | F<br>3 | G<br>4 | H<br>5 |
|---|---|---|---|---|---|
| Fiber Composition (wt. %) | | | | | |
| Pulp | 60 | 50 | 75 | 60 | 60 |
| PET | 40 | 50 | 25 | 40 | 40 |
| Forming Screen | | | | | |
| Mesh (per in) | 31 × 24 | 31 × 25 | 3 × 25 | 22 × 23 | 20 × 16 |
| Twill | 2/1 | 2/1 | 2/1 | 2/1 | 2/1 |
| Basis Weight | | | | | |
| (ox/sq yd) | 3.8 | 3.8 | 3.8 | 3.8 | 3.8 |
| Thickness (mils) | 35 | 27 | 38 | 44 | 48 |
| Peak Grab Tensile | | | | | |
| Dry(lbs) | | | | | |
| MD | 42.3 | 25.0 | 32.0 | 40.5 | 41.7 |
| CD | 39.6 | 16.0 | 22.0 | 40.7 | 35.3 |
| Wet(lbs) | | | | | |
| MD | 19 | 12.0 | 14.0 | 26.5 | 22.6 |
| CD | 19 | 6.0 | 10.0 | 26.4 | 22.9 |
| Peak Grab Elongation | | | | | |
| Dry(%) | | | | | |
| MD | 39.3 | 53.1 | 47.8 | 57.3 | 53.3 |
| CD | 48.2 | 94.5 | 66.3 | 62.4 | 71.7 |
| Dry(%) | | | | | |
| MD | 90 | 81.9 | 54.5 | 79.8 | 86.7 |
| CD | 100 | 102.6 | 107.4 | 85.4 | 98.9 |
| Elemndorf Tear | | | | | |
| Dry(g) | | | | | |
| MD | 1470 | 1100 | 950 | 1650 | 1633 |
| CD | 1065 | 850 | 1083 | 1483 | 1833 |
| Wet(g) | | | | | |
| MD | 1600 | 1100 | 950 | 2733 | 3800 |
| CD | 1900 | 580 | 583 | 3133 | 2475 |
| Mullen Burst (psi) | 122 | 63 | 68 | 87 | 93 |
| Air Permeability | | | | | |
| (cfm) | — | 230 | 98 | 223 | 248 |
| Absorptive Capacity | | | | | |
| (g/g) | 6.2 | 7.2 | 5.97 | 7.55 | 7.57 |
| Area Capacity | | | | | |
| ($g/m^2$) | 850 | 802 | 802 | 866 | 833 |
| Wicking Rate | | | | | |

TABLE II-continued

| SAMPLE<br>EXAMPLE | A<br>1 | E<br>2 | F<br>3 | G<br>4 | H<br>5 |
|---|---|---|---|---|---|
| (g/g/sec) | 38.7 | 46.6 | 32.9 | 20.78 | 34.45 |
| Flammability (sec) | | | | | |
| MD | 6.5 | 4.2 | 5.2 | 7.6 | 9.4 |
| NFPA-702 CD | 7.4 | 5.3 | 5.7 | 7.4 | 11.0 |

EXAMPLE 6

A fabric is made up from a wet-laid web composed of 60 weight percent cotton linters and 40 weight percent three-quarter inch by 1.2 denier polyethylene terephthalate (PET) staple fibers on the forming screen and under the conditions described in Example 1.

Physical properties of the product are listed in Table III.

TABLE III

| | |
|---|---|
| Basis Weight (oz/yd$^2$) | 4.9 |
| Thickness (mils) | 43.6 |
| Peak Grab Tensile | |
| Wet(lb) MD | 21.3 |
| CD | 20.0 |
| Peak Grab Elongation | |
| Wet(%) MD | 84.5 |
| CD | 83.1 |
| Elmendorf Tear | |
| Wet(g) MD | 3100 |
| CD | 3800 |
| Absorption Capacity (g/g) | 5.59 |
| Wicking Rate (g/g/sec) | 47.34 |
| Area Capacity (g/m$^2$) | 854 |
| Flammability (sec) | |
| NFPA-702 MD | 10.9 |
| CD | 9.2 |

From the foregoing examples, it will be seen that the nonwoven fabric of Example 1, Sample A of Table I, compares favorably with that produced in Example 5, particularly with respect to wicking rate, area capacity and absorption capacity.

In the foregoing examples, the Elmendorf tear strength, reported in grams is determined by repeated tests on an Elmendorf tear tester using single ply test strips. Thickness, reported in mils, is determined with an Aimes 212.5 loft tester on a single ply of the specimen.

The absorption capacity in Examples 1 to 3 and 6 is determined by a fluid absorption test method which measures the ability of a material to absorb as much fluid as it will hold without being flooded. A material sample is placed over a sintered glass porous plate and liquid from a reservoir is allowed to flow through the plate as it is absorbed by the material undergoing test. The weight of the reservoir is recorded before the test and again after the sample no longer absorbs additional fluid and has reached its maximum fluid saturation without flooding. The liquid absorption ratio is calculated and reported as the amount of fluid in grams absorbed per gram of the material sample. Liquid absorption ratio is independent of the sample's actual weight.

The wicking rate is a method used to determine the time elapsed in seconds for a liquid to travel 6 centimeters along a vertically suspended 2.5×10 cm test specimen with the lower end in contact with the liquid. The sample weight is recorded before and after the liquid has reached the six centimeter mark. The vertical wicking rate is reported as the ratio of the liquid weight to sample dry weight divided by the time elapsed in seconds (g of liquid/g dry weight of sample/sec). This ratio is then multiplied by 526. The test is repeated on specimens cut from the material in both the machine direction and the cross direction and the average is reported.

The method for determining absorbency under load or wet resiliency properties of nonwoven fabrics measures the absorbency of the material under load; specifically, it measures the absorbency capacity of the test specimen after successively increasing the load over the sample in 500 gram weight increments. The test is conducted as described above, and absorption capacity is determined in 500 gram increments from 50 grams to 2500 grams load weight.

Area Capacity is a derived number indicating the liquid holding capacity of a sample and is expressed in grams per square meter. Area capacity is calculated by multiplying the absorptive capacity of the test material expressed in grams of liquid per gram of material by the basis weight in grams per square meter.

The Mullen Burst test (ASTM-D3786-802) is used to determine the bursting strength of fabrics and films in a hydraulic diaphragm type bursting tester. The bursting strength is reported in pounds per square inch hydraulic pressure required to rupture a 1.2 inch diameter test specimen by distending it with force applied form one side by a flexible diaphragm of the same diameter as that of the specimen.

Grab Tensile and Grab Elongation are measured by ASTM D1682-64 test method, to determine the load in pounds and elongation in percent at the break point in a constant rate of extension tester.

Flammability is determined by using NFPA Test Method Number 702.

We claim:

1. A method of making a highly absorbent nonwoven fabric consisting essentially of wood pulp and staple length synthetic fibers which comprises forming a wet-laid web containing 50 to 75 weight percent wood pulp basis the dry weight of the fibers and 25 to 50 weight percent synthetic fibers having a fiber length in the range of from about one-quarter inch to about one inch, forming a compacted highly absorbent web of entangled fibers by subjecting the fibers in the wet-laid web to hydroentanglement, and drying said web to form said nonwoven fabric.

2. A method as defined in claim 1 wherein the wet-laid web contains 55 to 65 weight percent wood pulp and 35 to 45 weight percent staple synthetic fibers.

3. A method as defined in claim 1 wherein the length of said synthetic fibers is in the range of from about one-half inch (12 mm) to about seveneighths inch (22 mm).

4. A method as defined in claim 1 wherein the denier of the synthetic fiber is in the range of from about 0.5 to about 3.

5. A method as defined in claim 1 wherein the wet-laid web is subjected to the entanglement action of water jets ejected from 0.005 inch diameter orifices equivalent to at least two passes at a head pressure 200 psig, four passes at 600 psig and eight passes at 800 psig.

6. A method as defined in claim 5 wherein the weight of the nonwoven fabric is in the range of from about three to four ounces per square yard.

7. A method of making a highly absorbent nonwoven fabric consisting essentially of wood pulp and staple synthetic textile fibers free from added binders which comprises laminating a plurality of wet-laid webs each containing 50 to 75 weight percent wood pulp basis the dry weight of the fibers and 25 to 50 weight percent synthetic fibers having a fiber length in the range of one-quarter inch to one inch, combining said webs into a single compacted highly absorbent web of entangled wood pulp fibers and synthetic fibers by subjecting the laminated webs to hydroentanglement, and drying the hydroentangled web to form a highly absorbent fabric.

8. A highly absorbent nonwoven fabric having a basis weight in the range of three ounces to about eight ounces per square yard free from added binders and consisting essentially of 50 to 75 weight percent wood pulp basis the dry weight of the fibers and 25 to 50 weight percent synthetic fibers having a fiber length in the range of one-quarter inch to one inch uniformly admixed with one another in a wet-laid web and hydroentangled under sufficient energy to form a compact, highly absorbent fabric.

9. A nonwoven fabric according to claim 8 wherein the dry weight ratio of wood pulp to synthetic fibers is in the range of from about 1 to about 3.

10. A nonwoven fabric according to claim 8 wherein the synthetic fiber is a polypropylene fiber.

11. A nonwoven fabric according to claim 8 wherein the synthetic fiber is a nylon fiber.

12. A nonwoven fabric according to claim 8 wherein the synthetic fiber is a polyester fiber.

* * * * *